United States Patent [19]

McArthur

[11] Patent Number: 4,652,195

[45] Date of Patent: Mar. 24, 1987

[54] CASING STABBING AND POSITIONING APPARATUS

[76] Inventor: James R. McArthur, Rte. 1, Box 50, Tishomingo, Okla. 73460

[21] Appl. No.: 574,129

[22] Filed: Jan. 26, 1984

[51] Int. Cl.[4] ..... E21B 19/14

[52] U.S. Cl. ..... 414/22; 175/85; 294/88; 294/902; 901/39; 414/732; 414/744 A; 414/751; 414/735; 414/739

[58] Field of Search ..... 414/22, 745, 732, 744 A, 414/744 B, 744 C, 751, 752, 753, 23, 735, 729, 738, 739, 740, 741; 175/85, 52; 901/39; 294/902, 88

[56] References Cited

U.S. PATENT DOCUMENTS

| | | | |
|---|---|---|---|
| 1,998,714 | 4/1935 | Focha | 414/433 X |
| 2,450,934 | 10/1948 | Calhoun | 414/22 X |
| 2,615,681 | 10/1952 | True | 414/22 X |
| 3,540,603 | 11/1970 | Neumeier | 414/735 |
| 3,840,128 | 10/1974 | Swoboda, Jr. et al. | 414/22 X |
| 3,921,823 | 11/1975 | Bourree et al. | 414/22 |
| 4,013,178 | 3/1977 | Brown et al. | 414/22 |
| 4,077,525 | 3/1978 | Callegari et al. | 414/22 |
| 4,274,778 | 6/1981 | Putnam et al. | 414/22 |

FOREIGN PATENT DOCUMENTS

| | | | |
|---|---|---|---|
| 3004462 | 8/1981 | Fed. Rep. of Germany | 414/757 |

*Primary Examiner*—Frank E. Werner
*Attorney, Agent, or Firm*—William R. Laney

[57] ABSTRACT

A casing stabbing apparatus which includes a derrick bracket subassembly for attachment to a brace of a derrick, and a boom having an end pivotally connected to the bracket assembly for pivotation about a vertical axis and about a horizontal axis. A pair of arcuate casing gripping jaws is pivotally connected to the second end of the boom. A piston and cylinder assembly extends between the jaws to selectively converge and diverge the jaws. A second piston and cylinder assembly extends between the bracket assembly and the boom to elevate the boom by pivotation about a horizontal pivotal axis. A third piston and cylinder assembly extends between the bracket assembly and the boom to swing the boom laterally in pivotation about a vertical axis.

3 Claims, 9 Drawing Figures

CASING STABBING AND POSITIONING APPARATUS

FIELD OF THE INVENTION

This invention relates to apparatus for engaging and positioning large diameter casing, and more particularly, to an apparatus which can be mounted in a derrick extending upwardly over a drilling rig platform, and while so mounted, used to engage a section of well casing hanging from a crown block in the derrick, and further used to steer and align the casing threads to prevent cross threading with the threads of casing section therebelow as the two casing sections are threaded together.

BRIEF DESCRIPTION OF THE PRIOR ART

Various types of apparatus have been provided to assist in the manual alignment and interconnection of sections of drill pipe, casing and other tubular stock used in the drilling and completion of oil and gas wells. Most of these devices employ mechanical advantage, and in many cases hydraulics, to cause a pair of gripping elements or tongs to surround and engage the drill pipe or casing section, and then use leverage or hydraulics to swing the casing or drill pipe section to a precise position immediately over the well head at which is located a second section of drill pipe or casing to which the suspended section is to be connected.

U.S. Pat. No. 2,615,681 to True describes an apparatus for handling drill pipe so as to facilitate the coupling and uncoupling of sections of drill pipe being lowered into, or removed from, a well bore. The apparatus includes a carriage mounted on a trackway which is positioned on the floor of a derrick. An extensible and retractable arm is mounted on a housing which in turn is mounted on the carriage. The arm carries on a free end, a hook adapted to grasp and release a vertical stand of pipe. Power devices are provided for moving the carriage along the track, and for actuating the extensible and retractable arm and the hook which is carried on the free end of the arm. The apparatus is complicated in its construction, and is incapable of being easily mounted anywhere except on the rig floor. Moreover, the construction of the drill pipe handling apparatus is such that is it not well adapted for engaging and positioning large casing sections having diameters in excess of 12 inches.

U.S. Pat. No. 2,450,934 to Calhoun describes an apparatus for hydraulically actuating tongs used for making and breaking joints of drill pipe as the pipe is moved into and out of a well bore. The tongs employed are mounted on a post extending upwardly from a platform which can be positioned on the derrick floor. A detachable control head is utilized on the tong, and is operable by means of hydraulic power facilitating operation of the tong from a remote location by an operator. A hydraulically actuated work positioning and orienting arm is mounted on the supporting post, and is also controlled in its movement from a remote location. A number of complicated mechanical linkages are required for operation of the Calhoun apparatus, and the nature of its construction is such that it must be supported on the rig floor, rather than mounted in the derrick.

Willis U.S. Pat. No. 4,403,897 is a self-centering clamp for downhole tubulars which includes jaw members which can be caused to move vertically relative to a drilling platform by means of a hydraulic cylinder, and can then be caused to move in a convergent fashion with respect to each other so as to clamp upon a pipe section and guide the pipe section downwardly for engagement with a second section of pipe. The jaws are hydraulically actuated. Because the Willis structure is intended to lift a tubular, such as a section of drill pipe, from a horizontal to a vertical position before lowering it for engagement with a lower section of drill pipe, the apparatus is more complicated than the apparatus which would be needed to position sections of drill pipe or casing suspended from the crown block of a derrick. The clamping jaws utilized do not, in themselves, allow for any spinning or rotative movement of the tubular member which is engaged by the clamps.

In Reed U.S. Pat. No. 3,467,262, a pipe stabbing apparatus is disclosed in which an extensible boom is utilized for extending and retracting a pair of pivotal jaws capable of holding and releasing joints of drill pipe. The extensible boom may be pivoted in a horizontal plane through a desired angle to enable the stabbing head which carries the jaws to reach the points where the drill pipe is needed. A hydraulic piston and cylinder assembly is connected to the extensible boom for pivoting it about a vertical axis in order to vary the angular position of the extensible boom on its foundation. The pipe stabbing head on the end of the boom carries a jaw which is mechanically actuated to open and close the jaw about a section of drill pipe. The jaw provided is inadequate in size, structural strength and mode of operation for gripping extremely large diameter tubulars, such as casing sections exceeding about 10 inches in diameter, and no provision is made for the spinning or turning of the suspended casing or drill pipe section within the jaw once engagement is effected.

Podlesak U.S. Pat. No. 3,112,830, although not relating to oil field tubular goods in its application, does relate to a pole-handling device which includes an elongated extensible boom which is pivotally connected to a massive support structure. A hydraulic cylinder is provided for elevating and lowering the boom, and a pair of convergent and divergent jaws are carried on the free end of the boom. These jaws are clamped about the tubular by means of a hydraulic piston and cylinder arrangement which pivots the jaws about pivot points located near one end of the jaws. The jaws can also be made to undergo a yawing movement by means of a hydraulic piston and cylinder assembly. Due to the massive character of the support structure upon which the boom and associated hydraulics are carried, the Podlesak structure would be unsuitable for use in stabbing tubular goods suspended from the crown block of a derrick of the type used in the drilling and completion of oil and gas wells.

Guiers U.S. Pat. No. 3,514,822, discloses a transporter for manual slips used to engage and support a drill pipe section in a rotary table. The transporter apparatus includes a boom having a pipe gripping jaw at one end thereof which is mounted upon a supporting platform or table, which in turn is rested upon the rig floor. The boom is moved from a position offset from the drill pipe section to be engaged into a position where the jaws can grip the drill pipe. This pivotal motion of the boom is accomplished by a hydraulic piston and cylinder assembly which can be operated from a remote location at which a hydraulic control console is located.

A racking apparatus used for grasping and positioning pipe sections, drill collars and riser pipe sections is shown and described in Swoboda et al U.S. Pat. No. 3,840,128. The Swoboda apparatus includes a pair of jaws carried at the outer end of an elongated telescoping boom section, and these jaws are hydraulically opened and closed by the use of a hydraulic cylinder. The boom which carries the gripping jaws can be elevated by pivotation about a horizontal axis by means of a hydraulic cylinder. The entire boom and jaw assembly is mounted on a large platform, and is rotated by means of a motor drive. The manner in which the cooperating jaws of the Swoboda apparatus are hingedly interconnected requires the jaws to have a significant movement space in order to open and close. Moreover, the massive character of the Swoboda structure renders it incapable of mounting or securement at an elevated location in the drilling rig.

Other stabbing devices for engaging and positioning tubular elements such as drill pipe and casing, during the making up of strings of drill pipe and casing are disclosed in U.S. Pat. Nos. 2,822,024; 2,829,783 and 3,467,262.

Graham et al U.S. Pat. No. 2,206,184 discloses a stabbing guide which can be mounted in the derrick during an oil well drilling and completion operation to center and steady a casing section while it is aligned with, and joined to, a preceding section going into the well bore. The apparatus employed includes a guiding and restraining or steadying member which is used to partially engage the suspended casing section, and also includes a supporting carriage which is mounted in the derrick, and which permits the guiding and steadying member to be moved laterally from side-to-side of the derrick. The guiding and steadying member is merely a V-shaped supporting surface which can be moved in order to push a casing section contacted thereby. It is also possible to vary the angulation formed between the two members forming the V configuration in the guiding and steadying member in order to accommodate casing sections of varying sizes.

A similar device is shown in Guier U.S. Pat. No. 3,533,516. Here, however, the portion of the apparatus which is angulated to permit engagement with the tubular element being connected is carried on the end of, and formed integrally with, an elongated arm which is pivotable about a horizontal axis to cause the arm to be yawed or swiveled in a horizontal plane. The arm and the hydraulic piston and cylinder assembly used for imparting the yawing motion are mounted on an upright stand or standard, which in turn is supported on a base plate which can be rested on the rig floor or drilling platform.

In True U.S. Pat. No. 2,828,024, a pipe positioning device for mounting in a drilling derrick is disclosed. Here, a base platform, which includes a plurality of coplanar plates, is provided for supporting a hydraulic piston and cylinder assembly within an extensible boom structure. The extensible boom structure carries a forked pipe-engaging end portion which, in cooperation with a hydraulically actuated closure member, is used to engage a drill pipe or casing section. The base platform is pivotally supported on the derrick and can be elevated by pivotation about a horizontal axis so as to raise and lower the free outer end of the boom which carries the forked pipe-engaging structure. The length of the boom is altered by hydraulically extending a telescoping section. The True apparatus makes no provision for yawing or pivoting the boom about a vertical axis to achieve side-to-side motion.

A subterranean well pipe positioning apparatus is disclosed in Scaggs U.S. Pat. No. 4,274,777. In the Scaggs patent, an apparatus is disclosed for engaging and guiding suspended pipe section joints which hang from the crown block of a derrick. The apparatus includes an elongated boom which is mounted to the derrick through a rotary axle to permit pivotation upwardly and downwardly. A power cylinder is provided for rotating the apparatus about the horizontal rotary axle. A pair of guide jaws are pivotally attached to the outer end of the boom and are actuated by a cylinder which causes the jaws to open and close with respect to each other in order to engage a pipe to be selectively positioned.

A different approach to the engagement and selective guiding of a suspended casing section during section coupling operations is disclosed in Russe U.S. Pat. No. 4,295,527. In the Russe patent, the apparatus employed is first clamped or secured by a lower clamp assembly to that end of a lower casing section which protrudes slightly above the rig floor. Projecting upwardly, and offset from the axis of this casing section, is an upright member which extends substantially parallel to the axis of the lower casing section and a substantial distance above the upper end of the lower casing section. The upper end of the upright member carries an upper gripping assembly which includes a pair of pivotally mounted jaws which can be used to grip and engage the descending suspended casing section which is to be screwed into the lower casing section. The jaws are hydraulically actuated to clamp against the casing, but no provision is made to permit the casing to rotate on the swivel from which it is suspended. Moreover, it is necessary with the Russe structure to have a sufficient amount of the lower casing section extending upwardly from the rotary table to permit the lower clamp assembly to be clamped thereonto.

BRIEF DESCRIPTION OF THE PRESENT INVENTION

The present invention is an improved casing stabbing apparatus which can be easily hoisted into the upper portion of a drilling derrick and stably secured to one of the cross members of the derrick. The apparatus is completely automated and hydraulic in its operation, and can be controlled from a position of operation adjacent the stabbing apparatus in the derrick, or from a remote location, such as the rig floor. The apparatus is much less bulky and massive than many types of apparatus previously proposed for this purpose, and is maneuverable in several planes of motion to permit the apparatus to be more universally employed to engage and position tubular elements in alignment with a section of tubing therebelow which is to be threadedly engaged. The apparatus is especially well adapted for the engagement of very large diameter casing, and casing having a diameter up to 36 inches can be handled by the apparatus.

Broadly described, the casing stabbing apparatus of the invention includes a derrick bracket subassembly which is constructed to permit the entire casing stabbing apparatus to be quickly secured to a cross member or structural beam of the drilling derrick in which the apparatus is to be mounted and used. Detachably connected to the derrick bracket subassembly is a boom and jaw subassembly. The boom and jaw subassembly includes an elongated, extensible boom which can be hydraulically actuated to extend and retract telescoping sections of the boom with respect to each other. At the free outer end of the boom, a pair of jaws are pivotally supported on the boom and are hydraulically actuated in an opening or closing movement. The jaws carry roller elements which permit a casing or drill pipe section to be engaged without impairing or restricting the ability of the casing or the drill pipe section to swivel or turn about its axis, thus permitting the stabbing apparatus to remain engaged with the casing or drill pipe section as it is being threadedly connected to a section of drill pipe or casing suspended in the well bore from the rig floor. The extensible boom can be hydraulically actuated to pivot the boom about a horizontal axis at the end of the boom opposite the jaws, and to thereby cause the boom to be lifted and lowered. The boom can also be hydraulically moved in a yawing motion from side to side.

The stabbing apparatus preferably carries an arm or bar which is swively supported at one of its ends on the stabbing apparatus and which supports a control valve bank at its other end, thus permitting an operator to change his position for viewing and controlling the stabbing apparatus by swivelling the supporting arm, and thereby moving the control valve bank to a selected control location.

An important object of the present invention is to provide a casing stabbing apparatus which is constructed to include a pair of major interconnectable subassemblies which can be easily taken apart to facilitate transport, storage and operative mounting of the entire apparatus at a selected location in a drilling derrick.

A further object of the invention is to provide a casing stabbing apparatus which can easily handle very large diameter casing, and which, when in use, does not impair or prevent the casing or other tubular member engaged by the stabbing apparatus from spinning or rotating about its axis.

A further object of the invention is to provide a casing stabbing apparatus which is relatively light in weight (as compared to many such devices which have previously been proposed), yet which is mechanically strong and capable of engaging and selectively shifting the largest and heaviest casing sections now in use in the drilling of oil and gas wells.

A further object of the invention is to provide a casing stabbing apparatus which includes an extendable boom carrying jaws at one end thereof for engaging the casing, and which is hydraulically moveable in an up and down pivoting motion, or in a side-to-side pivoting motion, or both such motions simultaneously.

Yet another object of the invention is to provide a casing stabbing apparatus which is characterized in having a long and trouble free operating life.

Additional objects and advantages of the invention will become apparent as the following detailed description of the invention is read in conjunction with the accompanying drawings which illustrate a preferred embodiment of the invention.

BRIEF DESCRIPTION OF THE DRAWINGS

FIG. 9 is a side elevation view of a derrick bracket subassembly forming a part of the casing positioning apparatus of the present invention. A structural cross member forming a part of the derrick is shown in dashed lines.

DETAILED DESCRIPTION OF A PREFERRED EMBODIMENT OF THE INVENTION

Figure 1:
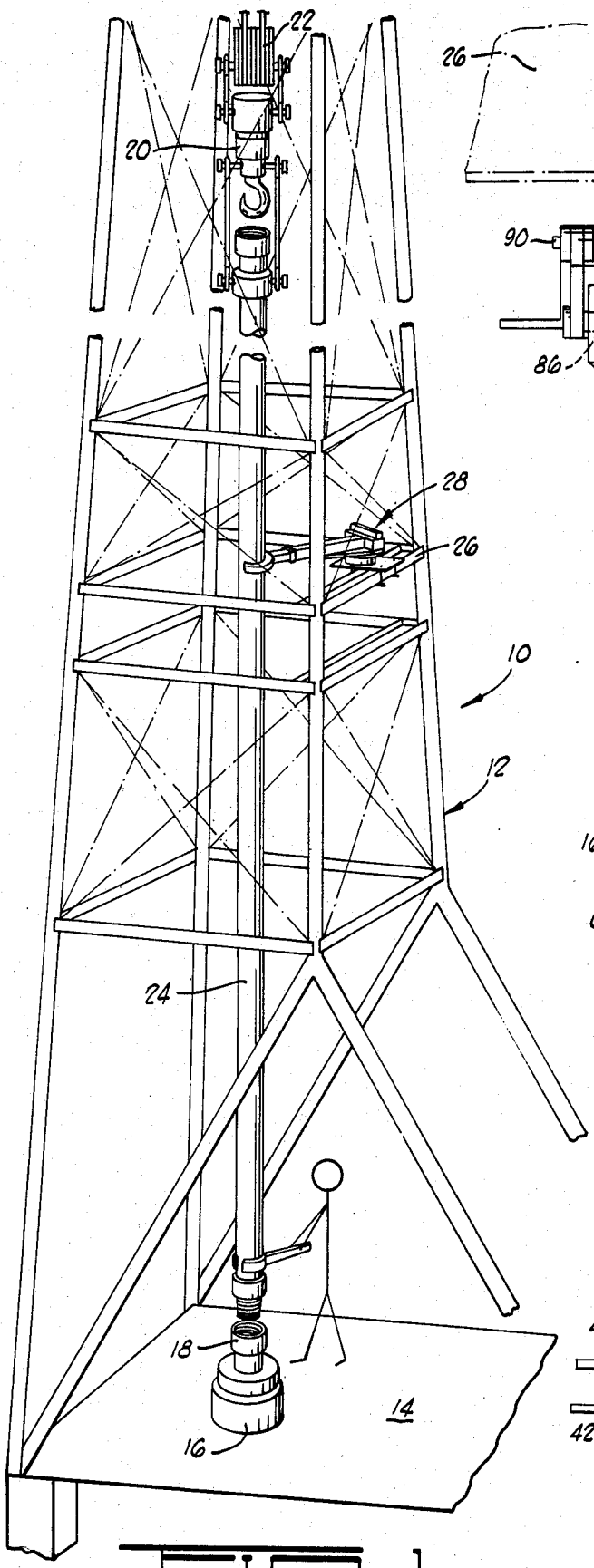
FIG. 1 is a perspective view, with parts broken away, showing a drilling rig platform with a derrick extending thereover, and with the present invention mounted in the derrick and in use for engaging a section of casing suspended from a crown block at the top of the derrick.

Referring initially to FIG. 1 of the drawings, shown therein is an oil well drilling rig 10 which, in that portion of the rig illustrated, includes a vertically extending derrick 12 and a rig floor or drilling platform 14. A rotary table 16 positioned on the rig floor 14 is used for supporting, by means of suitable slips (not shown), an elongated section of casing 18 which projects downwardly from the rig floor into the well bore.

In running a string of casing into a well, it is necessary to serially interconnect sections of the casing at a point of joinder at the rig floor, and to this end each succeeding section of casing to be attached to the section therebelow is suspended from a swivel 20 which is raised and lowered from a crown block 22 mounted at the top of the derrick 12. In FIG. 1, such a casing section 24 which is about to be connected to the section 18 therebelow is illustrated as suspended from the crown block 22. As is typical of the construction of a derrick, the derrick includes cross members 26 which are I-beams.

Figure 2:
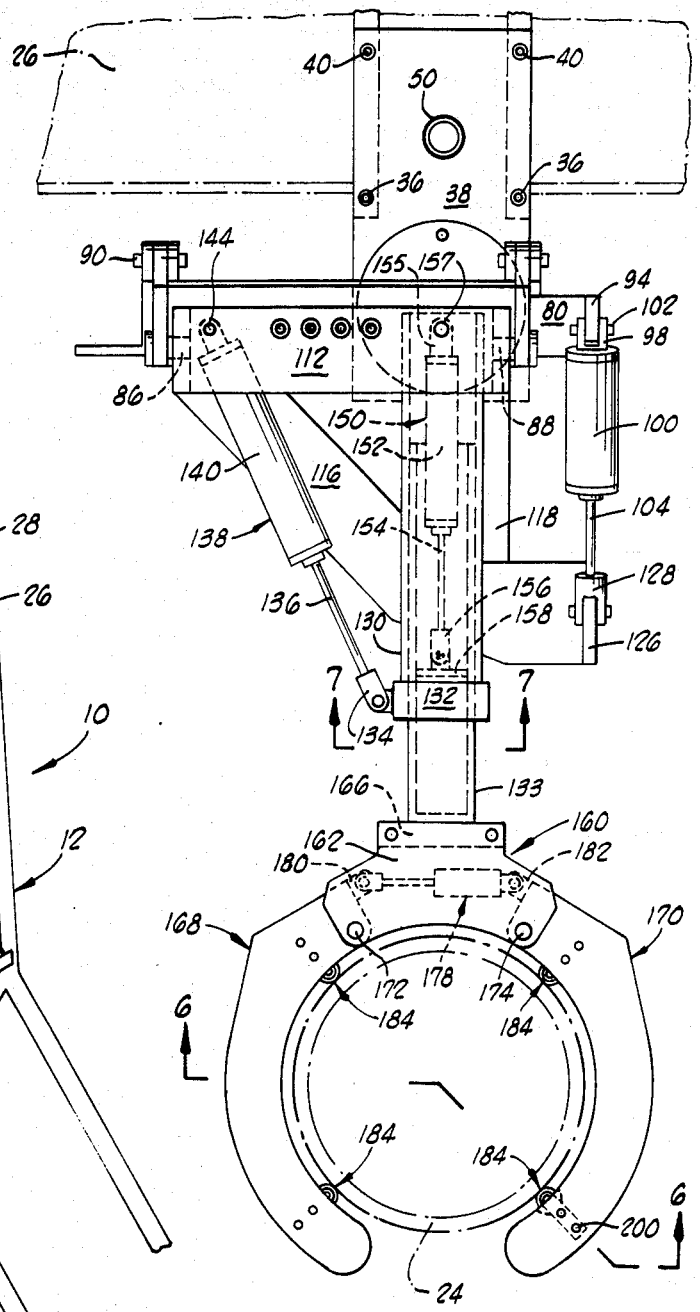
FIG. 2 is a plan view of the casing stabbing apparatus of the invention. An I-beam cross member of the derrick is illustrated in dashed lines.
Figure 3:
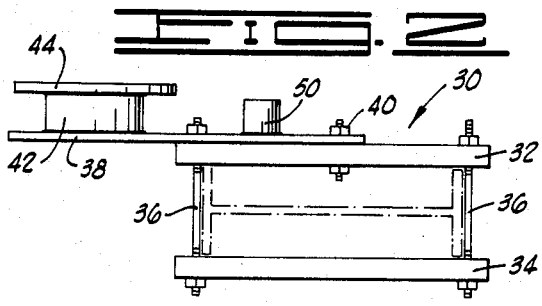
FIG. 3 is a side elevation view of the casing stabbing apparatus, illustrating in dashed lines, an I-beam constituting a structural member of a derrick in which the casing stabbing member is mounted, and also illustrating in dashed lines, a section of casing engaged by the casing stabbing apparatus.
Figure 3:
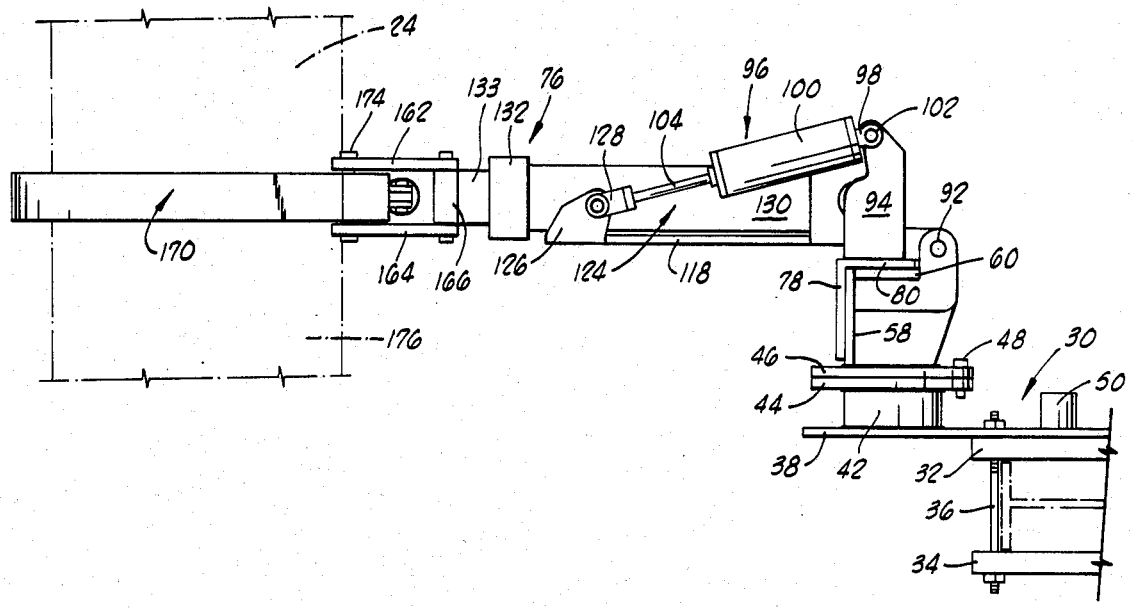

A principal purpose and usage of the present invention is to engage a median portion of a suspended section of large diameter casing utilizing the casing stabbing apparatus of the invention, and to thereafter swing or move the casing section so as to more precisely align the end of the suspended casing section over the section of casing hung by slips in the rotary table, thereby permitting the casing sections to be threadedly engaged. The casing stabbing apparatus of the present invention which is provided for this purpose is denominated generally by reference numeral 28. As illustrated in FIGS. 1–3, the casing stabbing apparatus is mounted in the derrick 12 by bolting the apparatus to one of the I-beam cross members 26.

The casing stabbing apparatus 28 is illustrated in detail in FIGS. 2–7, and includes a derrick bracket subassembly, designated generally by reference numeral 30, and employed for mounting the apparatus on a cross member 26. The derrick bracket subassembly 30 includes a pair of horizontally extending bracket plates 32 and 34 which are interconnected by a plurality of bolts 36. The bolts 36, in interconnecting the bracket plates 32 and 34, lock the bracket plates on the I-beam cross member 26. Two of the bolts 36 also extend upwardly through a base plate 38. Additional bolts 40 further secure the base plate 38 to the upper side of the upper bracket plate 32, as shown in FIGS. 2 and 3.

The base plate 38 is cantilevered inwardly of the derrick 12, and carries at one side of the base plate, a trunnion pedestal 42. The trunnion pedestal 42 projects vertically upwardly from the base plate 38 and has a lower trunnion plate 44 secured to its upper side. Pivotally supported on the lower trunnion plate 44 for pivotation about a centrally located pivot pin (not shown) is an upper trunnion plate 46. In the use of the casing stabbing apparatus, the upper trunnion plate 46 is generally pinned to the lower trunnion plate 44 by means of a locking pin 48. The locking pin 48 can be extended through selected ones of pairs of aligned apertures (not shown) in the upper and lower trunnion plates so as to permit the upper trunnion plate to be swiveled through approximately 180° and selectively locked in a chosen position of angulation with respect to the I-beam cross member 26 to which the derrick bracket assembly 30 is secured.

Figure 8:
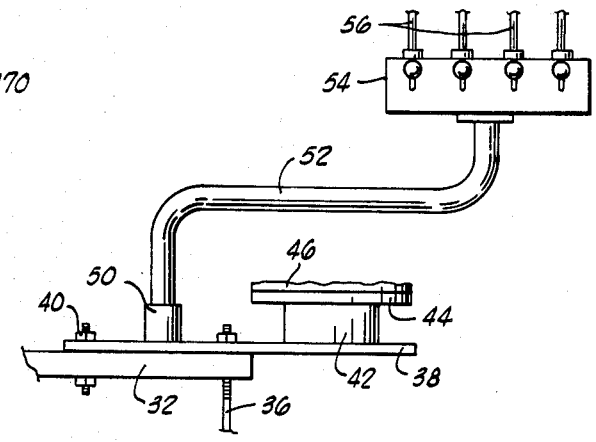
FIG. 8 is a side elevation view illustrating a valve bank control panel support arm and a valve bank control panel used for hydraulically controlling the movements of the casing stabbing apparatus of the invention.

On the opposite side of the base plate 38 from the trunnion pedestal 42 is a upwardly extending sleeve 50. The function of the sleeve 50 is to swivelly or pivotally receive one end of a generally S-shaped valve bank supporting rod 52, as shown in FIG. 8. At the upper end of the valve bank supporting rod 52, a control valve bank 54 is mounted and is accessible to an operator to control the movements of the casing stabbing apparatus. A plurality of hydraulic lines or conduits 56 extend from the valve bank 54 to various hydraulic cylinders used to hydraulically manipulate the casing stabbing apparatus.

Secured to the upper side of the upper trunnion plate 44 is a vertically extending support plate 58. At its opposite ends, the vertically extending support plate 58 carries a pair of apertured ear portions 59 and 61 which facilitate the lifting and movement of the casing stabbing apparatus. A horizontally extending support plate 60 is secured along the upper edge of the vertically extending support plate 58, and is further supported by a pair of gusset or diagonal plates 62 and 64 which are each welded along one vertical edge to the vertically extending support plate 58, and along a horizontal upper edge to the horizontally extending support plate 60.

The derrick bracket subassembly 30 is mounted so that the base plate 38 of this subassembly projects toward the inner side of the derrick as illustrated in FIGS. 1 and 2. The best position for mounting of the derrick bracket subassembly 30 will frequently be offset from direct lateral alignment with the centerline of the casing section 24, and such preferred mounting position is illustrated in FIG. 1.

At one end of the horizontally extending support plate 60, an L-shaped clevis plate 66 has its upper edge secured to the lower side of the horizontally extending support plate, and includes a vertically extending edge secured by welding or other suitable means to the rear side of the vertically extending support plate 58. Extending parallel to, and paired with, this clevis plate 66 is a second clevis plate 68 similarly secured to the underside of the horizontally extending support plate 60 and to the rear side of the vertically extending support plate 58. At the opposite end of the horizontally extending support plate 60, a similar pair of clevis plates 70 and 72 are secured between the horizontally and vertically extending support plates. The pairs of clevis plates 66–68 and 70–72 provide points of pivotal connection to the derrick bracket subassembly 30 of a boom and jaw subassembly designated generally by reference numeral 76.

The boom and jaw subassembly 76 includes a vertically extending facing plate 78 which is dimensioned and adapted to bear flatly against the forward side of the vertically extending support plate 58 which forms a portion of the derrick bracket subassembly 30. The boom and jaw subassembly 76 further includes an upper, horizontally extending plate 80 which is joined at one edge to the upper edge of the facing plate 78 and extends normal thereto so as to flatly abut and overlie the horizontally extending support plate 60.

Figure 4:
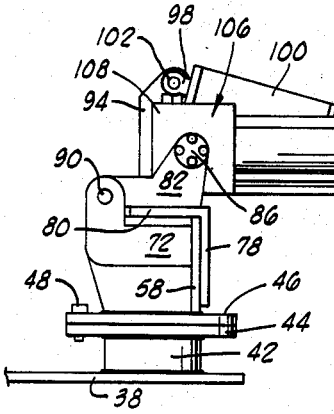
FIG. 4 is a side elevation view of a portion of the casing stabbing apparatus, and illustrates this portion of the casing stabbing apparatus as it appears when viewed from the opposite side thereof as from that side which is shown in FIG. 3.
Figure 5:
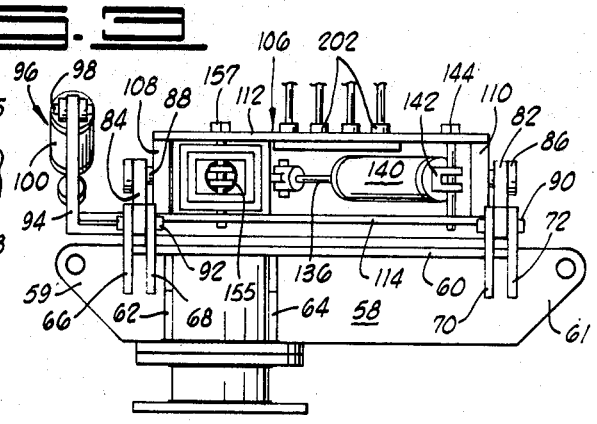
FIG. 5 is a rear elevation view of the casing stabbing apparatus as it appears when viewed from an angle displaced 90° from the angle of view depicted in FIG. 4.

In order to permit the boom and jaw subassembly 76 to be operatively connected to the derrick bracket subassembly 30, a pair of horizontally spaced journal and clevis plates 82 and 84 are secured to the upper side of the upper plate 80 and project vertically upwardly therefrom as shown in FIGS. 4 and 5. The upper end of each of the clevis plates 82 and 84 is apertured to facilitate extension therethrough of a journal shaft. These journal shafts are illustrated best in Figures in 2, 4 and 5 and are denominated by reference numerals 86 and 88. Each of the journal and clevis plates 82 and 84 further carry an ear portion, and these ear portions project rearwardly to a location between the pairs of clevis plates 66–68 and 70–72 carried on the derrick bracket subassembly 30. The journal and clevis plates 82 and 84 are pivotally pinned at this location to the pairs of clevis plates 66 and 68 and 70 and 72 by means of pivot pins 90 and 92 as shown in FIGS. 3–5.

At its end opposite the end which carries the clevis plate 82, the upper horizontally extending plate 80 has secured to the upper side thereof, an upwardly projecting clevis plate 94. The clevis plate 94 functions as an anchor plate or point of mounting for a hydraulic piston and cylinder subassembly 96 as depicted in FIGS. 3 and 5. The hydraulic piston and cylinder subassembly 96 includes a clevis 98 carried on one end of a hydraulic cylinder 100. The clevis 98 is pinned to the clevis plate 94 by means of a suitable pin 102. The piston and cylinder subassembly 96 further includes a piston rod 104 which can be extended and retracted with respect to the cylinder 100. The movement of the piston rod 104 is controlled from the control valve bank 54 which controls the flow of hydraulic fluid through hydraulic lines or conduits 56 to the cylinder 100 and to other hydraulic cylinders used in the casing stabbing apparatus of the invention, and hereinafter described.

The journal shafts 86 and 88 which project through apertures in the upper portions of the clevis plates 82 and 84 are used to pivotally support a boom housing subassembly, designated generally by reference numeral 106, for pivotation about a horizontal axis. The boom housing subassembly 106 includes a pair of end plates 108 and 110 to which the journal shafts 86 and 88 are secured. A pair of parallel upper and lower housing plates 112 and 114, respectively, are also a portion of the boom housing subassembly 106, and extend between, and interconnect the end plates 108 and 110. The upper and lower housing plates 112 and 114, together with the end plates 108 and 110, thus form a hollow, open sided rectangular parallelepiped. This open box as thus formed is pivotable about a horizontal axis which extends coincident with the axes of the two aligned journal shafts 86 and 88.

Projecting horizontally outwardly from the lower housing plate 114, and in coplanar alignment therewith, is a diagonal boom plate 116. The diagonal boom plate 116 is joined to a forwardly extending boom plate 118 which also projects horizontally from the lower housing plate 114, and is in coplanar alignment with the lower housing plate and with the diagonal boom plate 116. A lateral lift plate 120 is secured to both the diagonal boom plate 116 and the forwardly extending boom plate 118 and extends to one side of the forwardly extending boom plate 118 so as to be horizontally offset from the elongated extensible boom 124 forming a portion of the boom and jaw subassembly 76.

A lifting ear 126 projects vertically from one edge of the lift plate 120, as shown in FIGS. 2 and 3, and serves as a point of connection to a clevis 128 carried at one end of the piston rod 104 forming a part of the hydraulic piston and cylinder subassembly 96. It will be perceived that when the piston rod 104 is retracted into the cylinder 100, the effect of the retraction of the piston rod is to elevate the diagonal boom plate 116 and the forwardly extending boom plate 118. This in turn elevates the extensible boom 124 by pivoting the boom about a horizontal pivotal axis disposed within the boom housing subassembly 106. The extensible boom 124 includes a stationary sleeve 130 which is of rectangular cross-sectional configuration and extends outwardly from the boom housing subassembly 106. One end of the stationary sleeve 130 is rigidly and firmly secured in the boom housing subassembly and the other end is surrounded by a reinforcing collar 132. The reinforcing collar 132 prevents splitting of the stationary sleeve 130 as an internal extendable sleeve 133 slidably disposed in the stationary sleeve is telescopingly reciprocated inwardly and outwardly in the stationary sleeve as hereinafter described.

The reinforcing collar 132 has an eye 135 at one side thereof which permits a clevis 134 carried at one end of a piston rod 136 to be pivotally connected thereto. The piston rod 136 forms a part of a yaw control piston and cylinder subassembly designated generally by reference numeral 138. The yaw control piston and cylinder subassembly 138 further includes a hydraulic cylinder 140 which carries a clevis 142 at its base end. The clevis 142 at the base end of the cylinder 140 is pivotally pinned within the boom housing subassembly 106 by a pivot pin 144 which projects through the upper housing plate 112, through the clevis 142 and into the lower housing plate 114. It will be perceived from this description that the cylinder 140 and the piston rod 136 which is extensible therefrom can be pivoted about a vertical axis constituted by the pivot pin 144. This action is used for causing the boom 124 to undergo a yawing or swiveling movement from side to side about a vertical axis.

The boom 124 is variable in length, and to this end, the telescoping extendable internal sleeve 133 is provided. The sleeve 133 is of rectangular cross-sectional configuration, and is dimensioned to slidingly telescope within the stationary sleeve 130 so that the extensible sleeve can be extended out of, and retracted into, the stationary sleeve 130. To effect the extension and retraction of the inner sleeve 133, a boom extending piston and cylinder subassembly designated generally by reference numeral 150 is provided. The boom extending piston and cylinder subassembly 150 includes a hydraulic cylinder 152 having a piston rod 154 extensible therefrom upon actuation. The cylinder 152 carries a clevis 155 which is pivotally pinned within the boom housing subassembly 106 to facilitate horizontal yawing movement of the boom 124 which is also pinned in the subassembly 106 by the pin 157. The piston rod 154 has a clevis 156 connected through a connection plate 158 to the extensible sleeve 133 so that, when the piston rod 154 is extended from the cylinder 152, the extensible sleeve 133 will be extended outwardly from the stationary sleeve 130 to increase the length of the extensible boom 124.

The sleeve 133 has secured to the free outer end thereof, a casing jaw supporting bracket designated generally by reference numeral 160. The casing jaw supporting bracket 160 includes an upper plate 162 and a lower plate 164 which are connected to the opposite sides of a transverse bar 166 which extends between the rear edges of the upper and lower plates.

The function of the casing jaw supporting bracket 160 is to pivotally support and carry a pair of pivotally mounted arcuate casing jaws, designated generally by reference numerals 168 and 170, at the outer end of the elongated extensible boom 124. The casing jaws 168 and 170 are each mounted in the casing jaw supporting bracket 160 by means of pivot bolts 172 and 174, respectively. Each of the pivot bolts 172 and 174 is pinned through a corner of the respective casing jaw 168 and 170 so that each of the arcuate casing jaws can be caused to converge upon and grip a section of large diameter casing, such as that illustrated in dashed lines in FIGS. 2 and 3 and there denominated by reference numeral 24. Each of the arcuate casing jaws 168 and 170 is also connected to a piston and cylinder subassembly 178 which functions to interconnect the casing jaws and to cause them to be pivoted toward and away from each other as the piston rod of the assembly 178 is extended and retracted. As shown in FIG. 2, the piston and cylinder subassembly 178 is connected to opposed ears 180 and 182 located at the corner of one of the ends of each of the arcuate casing jaws 168 and 170, and the jaws are mounted for pivotation about the respective pivot bolts 172 and 174.

Figure 6:
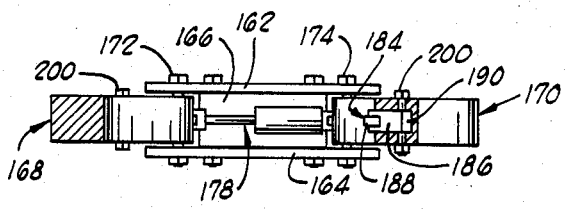
FIG. 6 is a sectional view taken along line 6—6 of FIG. 2, and illustrating portions of the casing gripping jaws forming a part of the casing stabbing apparatus of the invention.
Figure 7:
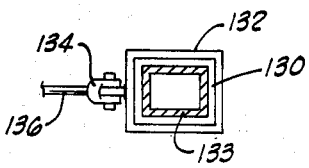
FIG. 7 is a sectional view taken along line 7—7 of FIG. 2.

Each of the arcuate casing jaws 168 and 170 is a thick metallic plate having an inner peripheral surface cut on the circumference of a circle, and each carries four moveable roller elements. The roller elements are identically constructed and each is designated generally by the reference numeral 184. Each of the roller elements 184 includes, as shown in FIG. 6, a short bar 186 which has its radially inner end slotted to rotatably receive a small roller 188 pinned in the bar. Each of the bars 186 is dimensioned to slide radially inwardly and outwardly in an accommodating slot 190 cut radially into the respective casing jaw, and dimensioned to closely and slidably receive the bar. Each bar 186 has at least two spaced pin holes formed downwardly therethrough intermediate its length. The respective casing jaw also includes two spaced pin holes formed through the casing jaw in alignment with the slot 190. The pin holes are dimensioned to receive a positioning pin 200 which can be inserted through aligned hole pairs when the respective bars are in their radially innermost positions, or can be inserted through other aligned hole pairs to lock the respective bars 186 in position at a time when the bars are moved to their radially outermost positions. In this way, by the use of the positioning pins 200 associated with each of the slots 190 and bars 186 of the moveable roller elements 184, the roller elements may be moved radially inwardly or radially outwardly so that the arcuate casing jaws can be adapted in this fashion for engaging a very large casing section having an outside diameter of about 24 inches, or a smaller casing section having an outside diameter of 16 inches.

It should be pointed out that the hydraulic power fluid conduits which extend to the cylinder of the piston and cylinder subassembly 178, to the cylinder 140 of the yawing piston and cylinder subassembly 138, and the cylinder 152 of the boom extending piston and cylinder subassembly 150 all extend in protected positions to a point above the upper plate 80 where quick disconnect fittings 202 are provided to permit quick connection to be made with flexible hydraulic power fluid conduits 56 extending from this location to the valves on the control valve bank 54. The control valve bank 54 can be swiveled to a selected position by movement of the S-shaped valve bank supporting rod 52, or can even be located at a remote location, such as on the rig floor 14, to permit an operator at that location to control the extension and retraction of the several piston rods used to control movements of the casing stabbing apparatus of the invention.

OPERATION

In utilizing the casing stabbing apparatus 28 of the invention, the apparatus will be mounted at some intermediate location on the derrick 12, such as on the cross member 26 as illustrated in FIG. 1. To mount the casing stabbing apparatus 28 in this manner, the bolts 36 are extended on opposite sides of the I-beam and through the upper bracket plate 32 and lower bracket plate 34 of the derrick bracket subassembly 30.

When the derrick bracket subassembly 30 has been bolted to the cross beam 26 of the derrick 12 in the manner described, the boom and jaw subassembly 76 is then swiveled or pivoted to a position where the extensible boom 124 projects toward the casing section 24. This is accomplished by rotating the upper trunnion plate 46 on the lower trunnion plate 44 until approximate alignment of the extensible boom 124 with the casing section 24 has been attained. At this point, the upper trunnion plate 46 is pinned to the lower trunnion plate 44 by the use of the locking pin 48 extended through registering apertures in the two trunnion plates.

With the casing stabbing apparatus 28 thus mounted and positioned, the various hydraulic piston and cylinder subassemblies are then used to engage a casing section 24 hung from the swivel 20 which in turn is suspended from the crown block 22. Prior to engaging the casing section, however, the moveable roller elements 184 carried on the two arcuate casing jaws 168 and 170 have been adjusted radially inwardly or radially outwardly, according to whether the casing section to be engaged is a very large diameter casing, or a relatively smaller diameter casing section. This is accomplished by initially manually removing the positioning pins 200 to permit the bars 186 of each of the moveable roller elements 184 to be moved radially inwardly or outwardly to the desired position. When this has been accomplished, the positioning pins are reinserted to lock the moveable roller elements 184 in the proper position for casing engagement.

After this, the piston and cylinder subassembly 178 is actuated to retract the piston thereof and thereby cause the arcuate casing jaws 168 and 170 to be opened apart from each other by pivotation of each of the jaws about the respective pivot bolts 172 and 174. With the arcuate casing jaws 168 and 170 thus opened apart from each other, the jaws are then moved to a position where they surround the suspended casing section 24. This is accomplished by means of the piston and cylinder subassembly 138 and the piston and cylinder subassembly 150.

By extending the piston rod of the boom extending piston and cylinder subassembly 150, the extensible sleeve 133 is caused to slide outwardly from the stationary sleeve 130 to extend the length of the boom, and thus cause the arcuate casing jaws 168 and 170 to move outwardly until the desired position of the jaws around and on opposite sides of the casing section 24 has been achieved. This is aided by extension or retraction of the piston rod 136 of the yawing piston and cylinder subassembly 138 to cause the extensible boom to pivot about the vertical axis of pivotation which is coincident with the pivot pin 157. The jaws 168 and 170 are thereby caused to swing laterally in either direction as may be necessary to align the jaws with the casing section.

When the casing jaws 168 and 170 have been brought to a position on opposite sides of the casing section 24, the piston rod of the piston and cylinder subassembly 178 is extended. This movement causes the jaws to pivot inwardly toward each other until the rollers 188 of the several moveable roller elements 184 engage the casing at locations which are spaced about 90° from each other about the periphery of the casing. It should be noted that when the casing is engaged in this fashion, the casing can still spin about its axis because the rollers 188 carried rotatably at the radially inner ends of the bars 186 can undergo rotation to accommodate such casing spinning movement.

When the casing section 24 has been thus engaged by the jaws 168 and 170, the operator of the casing stabbing apparatus 28, by appropriate manipulation of the valves at the control valve bank 54 can cause the section of casing to be moved in small increments in any direction. Thus, with the aid of personnel located on the rig floor 14, the heavy section of large diameter casing 24 can be brought to a position directly above the section of casing 18 held by slips in the rotary table 16. Then, as the crown block is very slowly lowered, the threads at the lower end of the suspended casing section 24 can be made to precisely line up with, and engage the threads in the casing section 18 in the rotary table. The suspended casing section 24 can be spun up to tighten the threads into engagement with each other and effect the joint without damage to the threads, and with a minimum amount of manual manipulation required by personnel on the rig floor. Importantly, the dangerous procedure of having a crew member manually manipulating the heavy casing section from a position high in the derrick is totally eleminated.

When the casing section has been spun up to form the joint with the casing section 18, the casing jaws 168 and 170 of the casing stabbing apparatus are opened apart from each other by retraction of the piston rod of the piston and cylinder subassembly 178. Opening the jaws permits them to be withdrawn from around the casing by retracting the piston rod of the boom extending piston and cylinder subassembly 150.

In many instances, it will be desired, at times when the casing stabbing apparatus 28 is not in use, to move the boom 124 to a position where it does not project out over the rig floor 14, and does not interfere with other pipe or tubular member handling operations. To accomplish this, the piston rod 104 of the hydraulic piston and cylinder subassembly 96 is retracted so that the boom 124 is pulled upwardly. The boom is permitted to pivot in this upward direction by pivotation of the boom housing subassembly 106 on the journal shafts 86 and 88. Raising of the extendable boom in this fashion is effected by the upward lifting of the diagonal boom plate 116, the forwardly extending boom plate 118 and the lift plate 120 to which the piston rod 104 is connected through the clevis 128. When it is desired to again use the casing stabbing apparatus 28, the piston rod 104 of the hydraulic piston and cylinder subassembly 96 is extended to lower the diagonal boom plate 116, forwardly extending boom plate 118 and lift plate 120, and thereby lower the extensible boom 124 to its horizontally extending position.

It should be pointed out that the casing stabbing apparatus of the present invention is easily transported, assembled and used by reason of the construction of the casing stabbing apparatus in two major subassemblies which can be easily disconnected from each other to facilitate ease of transport and storage of the parts of the apparatus. Thus, the boom and jaw subassembly 76 can be quickly disconnected from the derrick bracket subassembly 30 by removing the pivot pins 90 and 92 to permit the clevis plate pairs 66–68 and 70–72 to be disconnected from the clevis plates 82 and 84 carried on the upper horizontally extending plate 80 of the boom and jaw subassembly. The apertured end portions 59 and 61 of the vertically extending support plate 58 of the derrick bracket subassembly 30 provide locations where cables or hoisting slings can be quickly attached to the derrick bracket subassembly 30 to permit it to be hoisted into the rig and secured to one of the cross beams 26 in the manner described.

From the foregoing description of the invention, it will be apparent that the casing stabbing apparatus of the invention provides a compact, relatively simply constructed, mechanically rugged and highly useful apparatus for engaging and guiding a suspended casing section as it is lowered for threaded engagement with a casing section retained in the rotary table at the rig floor. The apparatus can be operated from a location in the derrick by a single operator, or can even be remotely operated from the rig floor by appropriate extension of the necessary hydraulic conduits to the control valve bank 54 when such is disposed on a location on the rig floor. The apparatus is particularly well suited for engaging very large diameter casing weighing as much as 180 pounds per foot, and constituting a safety hazard to operating personnel who attempt to manually manipulate the suspended casing section to achieve the necessary alignment.

Although the casing stabbing apparatus has been depicted in a particular form constituting a preferred embodiment, it will be understood that various changes and modifications in the illustrated and described structure can be effected without departure from the basic principles which underlie the invention. Changes and innovations of this type are deemed to circumscribed by the spirit and scope of the invention except as such spirit and scope may be necessarily limited by the appended claims, or reasonable equivalents thereof.

What is claimed is:

1. A casing stabbing apparatus for engaging swinging, suspended, vertically extending sections of well casing, and maneuvering them into a position to be lowered to the well head which apparatus comprises:

a derrick bracket subassembly adapted for selective attachment to a horizontally extending structural member of a derrick adapted for use in the drilling and completion of oil and gas wells, said derrick bracket subassembly comprising:

bracket plate means adapted for securement to said horizontally extending derrick structural member at a selected location therealong;

a trunnion pedestal connected to said bracket plate means;

a lower trunnion plate secured to said trunnion pedestal and having a lower side and an upper side;

an upper trunnion plate mounted on the upper side of said lower trunnion plate, and rotatably mounted thereon for rotation about a first vertical axis;

means for selectively fixedly securing said upper trunnion plate to said lower trunnion plate at a selected position; and support plate means secured to the upper side of said upper trunnion plate and moveable therewith relative to said lower trunnion plate;

a boom housing subassembly detachably and pivotally connected to said upper trunnion plate for pivotation about a first horizontal axis;

a boom and jaw subassembly connected to said boom housing subassembly to facilitate pivotation of said boom and jaw subassembly about said first horizontal axis, and to facilitate quick removal of said boom and jaw subassembly and said boom housing subassembly concurrently from said upper trunnion plate during disengagement of said casing stabbing apparatus from said horizontally extending derrick structural member, and to thereby facilitate lowering the disassembled stabbing apparatus downwardly through the interior of the derrick, said boom and jaw subassembly including:

an elongated extensible boom having one end connected to said boom housing subassembly, said extensible boom comprising:

a stationary hollow sleeve connected to said boom housing subassembly for pivotation about a second vertical axis and with said boom housing subassembly about said first horizontal axis; and an extensible sleeve slidingly and telescopingly engaged with said stationary sleeve for extension and retraction relative thereto of said boom to selectively increase the length thereof;

means for selectively extending and retracting said boom comprising:

a boom lengthening piston and cylinder subassembly located within the hollow interior of said stationary hollow sleeve and including:

a piston rod connected to said extensible sleeve; and a cylinder having an end pivotally connected to said boom housing subassembly for pivotation about common first horizontal and second vertical axes concurrently with the pivotation of said boom about said first horizontal and second vertical axes;

a yawing piston and cylinder subassembly for pivoting the boom about said second vertical axis, said yawing piston and cylinder subassembly having one end connected to said boom housing subassembly for pivotation about a third vertical axis;

a pair of arcuate casing jaws pivotally mounted on the end of said elongated, extensible boom opposite its end connected to said boom housing subassembly;

adjustable roller means carried on said casing jaws for selectively adjusting the diametric dimension defined inside said jaws to thereby facilitate stabbing casing sections of varying dimensions, said adjustable roller means including a plurality of spaced, radially moveable roller elements, easy of said roller elements comprising:

a bar slidably mounted in one of said jaws for movement radially inwardly and radially outwardly in the respective jaw in which it is mounted;

a roller rotatably mounted in the radially inner side of said bar for undergoing rotation when said roller is in contact with a tubular element passed through, and engaged, by said jaws; and means for adjustably fixing the bar at a selected radial position in the respective bar in which it is mounted;

a jaw actuating piston and cylinder subassembly connected between said jaws for selectively pivoting said jaws in converging and diverging movements to facilitate the engagement and disengagement of a section of casing therebetween, said jaw actuating piston and cylinder subassembly connected between said jaws including a jaw actuating cylinder and a jaw actuating extensible piston rod reciprocable in said jaw actuating cylinder for extension in a direction normal to the direction of extension and retraction of said elongated boom, and normal to the longitudinal axis of said elongated extensible boom; and means for pivoting said boom to raise and to lower the end of said boom carrying said jaws, while pivoting the end of said boom connected to said boom housing subassembly about said first horizontal axis.

2. A casing stabbing apparatus as defined in claim 1 and further characterized as including:

an upwardly extending sleeve mounted on the upper side of said bracket plate means and opening upwardly;

a valve bank supporting rod swivelly carried in said upperwardly extending sleeve for swiveling pivotation about a third vertical axis coincident with the axis of said sleeve; and a control valve bank mounted on said supporting rod and including control valves for controlling the actuation of said yawing piston and cylinder subassembly, said boom lengthening piston and cylinder subassembly, said means for pivoting said boom to raise and lower the end of said boom and said jaw actuating piston and cylinder subassembly.

3. A casing apparatus as defined in claim 2 wherein said boom housing subassembly comprises:

a pair of spaced end plates; and a pair of spaced housing plates secured to said end plates and forming therewith a right parallelepiped open at one side and receiving through said open side said pivotally received end of said boom; and journal shafts projecting horizontally from said end plates; journal and clevis plates receiving said journal shafts for pivotally supporting said boom housing subassembly; and means detachably connecting said boom housing subassembly to said support plate means of said derrick bracket subassembly.

* * * * *